United States Patent [19]

McCallum

[11] Patent Number: 4,667,411

[45] Date of Patent: May 26, 1987

[54] HAND-HELD POWERED GASKET PUNCH

[76] Inventor: Orval C. McCallum, 10247 SE. Long St., Portland, Oreg. 97266

[21] Appl. No.: 773,936

[22] Filed: Sep. 9, 1985

[51] Int. Cl.[4] ..... B26F 1/00

[52] U.S. Cl. ..... 30/368; 30/362

[58] Field of Search ..... 30/358, 362, 368, 130; 83/639, 686

[56] References Cited

U.S. PATENT DOCUMENTS

| | | | |
|---|---|---|---|
| 1,102,544 | 7/1914 | Price | 83/545 |
| 2,374,400 | 4/1945 | Westervelt | 30/358 |
| 2,808,080 | 10/1957 | Dion-Biro | 83/686 |
| 3,234,835 | 2/1966 | Archbold et al. | 83/139 |
| 3,238,832 | 3/1966 | Williamson | 83/639 |
| 3,722,337 | 3/1973 | Brolund et al. | 83/639 |
| 3,871,254 | 3/1975 | Whistler, Jr. et al. | 83/139 |
| 3,924,330 | 12/1975 | Mitsuhashi et al. | 30/358 X |

*Primary Examiner*—Douglas D. Watts
*Attorney, Agent, or Firm*—Kolisch, Hartwell & Dickinson

[57] ABSTRACT

A gasket punch of the instant invention includes a frame having a grip integrally formed therewith, a piston chamber located ahead of the grip, and a die platform spaced beneath the piston chamber, also ahead of the grip. The punch includes a fluid connector for connecting the punch to a pressurized fluid supply. A piston and shaft are mounted for reciprocating movement in the piston chamber and are operable to receive a punch element on the free end of the piston shaft. Punch and die elements are provided to form holes of various sizes. The punch and die elements are interchangeable. A resilient stripping element is provided for each punch element to remove the punched gasket material from the punch element. An adjustable bail and plural guide elements are provided to accurately position the punch relative the gasket material to be punched. A trigger valve is provided to connect the fluid supply with an upper portion of the piston chamber, thereby causing the piston to move downwards, carrying the punch element therewith and forming a hole in the gasket material.

11 Claims, 2 Drawing Figures

HAND-HELD POWERED GASKET PUNCH

BACKGROUND AND SUMMARY OF THE INVENTION

The instant invention relates to a punch for forming holes in gasket material. Specifically, the punch of the instant invention is a small, portable hand-held device which may be used at a gasket installation site for preparing gasket material prior to installation.

Placement of gasket material, and more particularly placement of gasket material in boilers on board ships requires the precise positioning of holes in gasket material so that the gasket may be properly placed over bolts or pins which are located on one part of the unit to be sealed prior to the position of the second part of the unit. The general method of forming holes in the gasket material is by means of a hand-held punch and a hammer.

Although some forms of hydraulically operated punches are known, they are either too large and heavy to be convenient or require use of a liquid, pressurized power source, which is generally not available at the installation site.

An object of the instant invention is to provide a small, light weight, hand-held gasket punch which is easily manipulated with one hand.

Another object of the instant invention is to provide a hand-held gasket punch which is pneumatically operated.

A further object of the instant invention is to provide a hand-held gasket punch which includes means for properly aligning the punch relative the gasket material.

Yet another object of the instant is to provide a hand-held gasket punch which is easily adaptable to punch holes of various sizes in gasket material.

Another object of the instant invention is to provide a hand-held gasket punch which includes means for automatically stripping the punched gasket material from the punching element.

The gasket punch of the instant invention includes a frame having a grip integrally formed therewith, a piston chamber located ahead of the grip, and a die platform spaced beneath the piston chamber, also ahead of the grip. The punch includes a fluid connector for connecting the punch to a pressurized fluid supply. A piston and shaft are mounted for reciprocating movement in the piston chamber and are operable to receive a punch element on the free end of the piston shaft. Punch and die elements are provided to form holes of various sizes. The punch and die elements are interchangeable. A resilient stripping element is provided for each punch element to remove the punched gasket material from the punch element. An adjustable bail and plural guide elements are provided to accurately position the punch relative the gasket material to be punched. A trigger valve is provided to connect the fluid supply with an upper portion of the piston chamber, thereby causing the piston to move downwards, carrying the punch element therewith and forming a hole in the gasket material.

These and other objects and advantages of the instant invention will become more fully apparent as the description which follows is read in conjunction with the drawings

DETAILED DESCRIPTION OF THE PREFERRED EMBODIMENT

Figure 1:
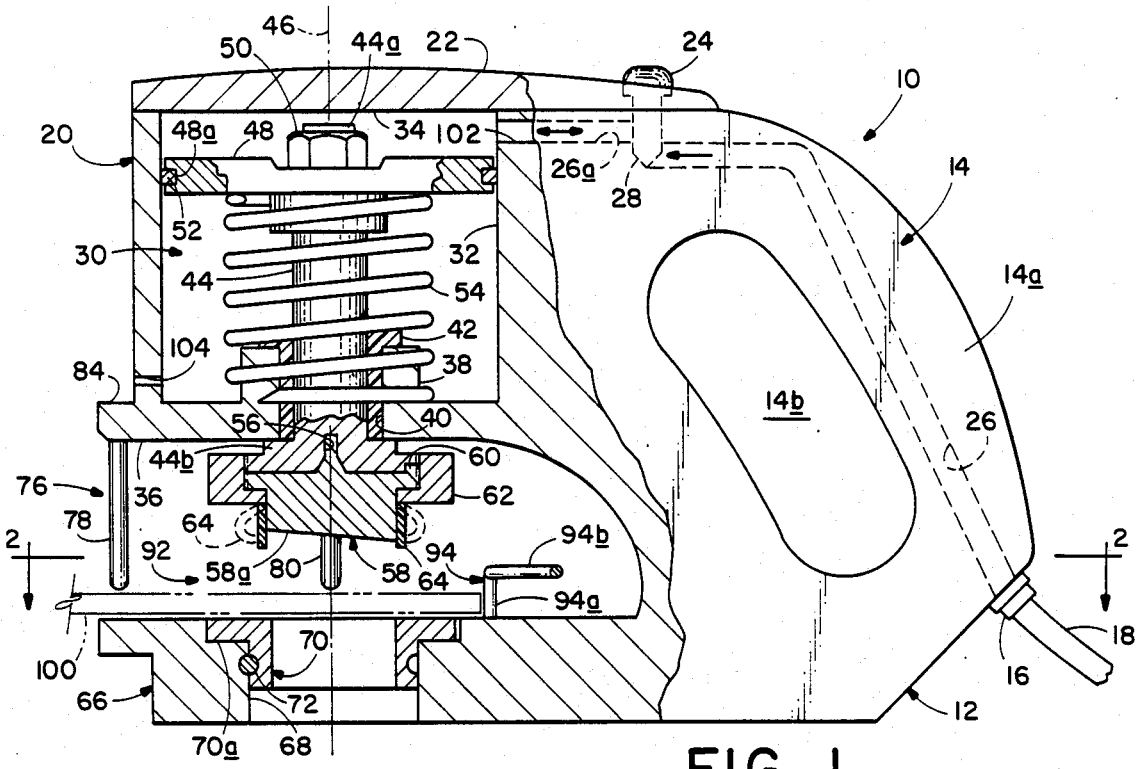
FIG. 1 is a side view of the punch of the instant invention, with portions broken away to show detail.

Turning now to the drawing and initially to FIG. 1, a hand-held powered gasket punch constructed according to the invention is shown generally at 10. Punch 10 includes a frame, shown generally at 12. Frame 12 includes a grip portion 14 which includes a handle **14*a* and a wasted area, 14*b*, through which the operator may place his or her fingers. A connector 16 is provided to attach punch 10 to a fluid supply, which is represented by a hose 18. A piston cylinder 20 is located forward of grip 14 and is integrally formed with the upper portion of frame 12. A cylinder cap 22 covers the top of piston cylinder 20 and extends rearwardly over the top of grip 14**.

A trigger valve 24 extends through cap 22 into the interior of frame 12. A conduit 26 extends from the base of grip 14, adjacent connector 16, upwards through handle **14*a* and connects with the lower portion of a valve seat 28 which receives the lower portion of valve 24. A continuation 26*a* of conduit 26 extends from valve seat 28 to the interior of piston cylinder 20**.

A piston chamber 30 is defined by piston cylinder 20 and cylinder cap 22. In the preferred embodiment, chamber 30 has a cylindrical side wall 32, defined by the inner surface of cylinder 20. Chamber 30 has a closed upper region, defined by a lower surface 34 of cylinder cap 22. Piston cylinder 20 has a base portion 36 which includes a piston shaft guide portion 38. A piston shaft guide bore 40 is located within guide portion 38. A bearing 42 extends over the top of guide portion 38 and through bore 40. Bearing 42, in the preferred embodiment, is formed of a polyurethane material.

A piston shaft 44 is mounted in bearing 42 for reciprocating movement along a shaft axis 46. A piston 48 is secured to one end of shaft 44 by a nut 50 which is received on a threaded portion **44*a* of shaft 44. Piston 48 has a groove 48*a* about the periphery thereof. A piston ring 52 is received in groove 48*a* to form a tight seal between piston 48 and side wall 32. A spring 54 extends between the lower surface of piston 48 and the upper portion of base 36. Spring 56** is also referred to herein as piston shaft return means.

The other end **44*b* of piston shaft 44 has a punch receiving indent 56 for centering a punch element 58. A second indent 60 is provided to prevent element 58 from rotating about axis 46. Element 58 has a cutting face or punch surface 58*a* which is substantially planar and which is inclined with respect to axis 46. Axis 46 defines a punch center point on cutting face 58*a***.

Element 58 is fixed to shaft 44 by a collar 62 which is threadably received on an expanded portion of shaft end **44*b***.

Collar 62 and end **44*b*** comprise what is referred to herein as punch receiving means.

A gasket stripper, or stripping sleeve, 64 is carried on the outer periphery of element 58. Stripper 64 is conformal with the sides of element 58 and extends downwards beyond cutting face **58*a*. Stripper 64 is operable to force gasket material off of element 58** once the gasket has been punched.

Figure 2:
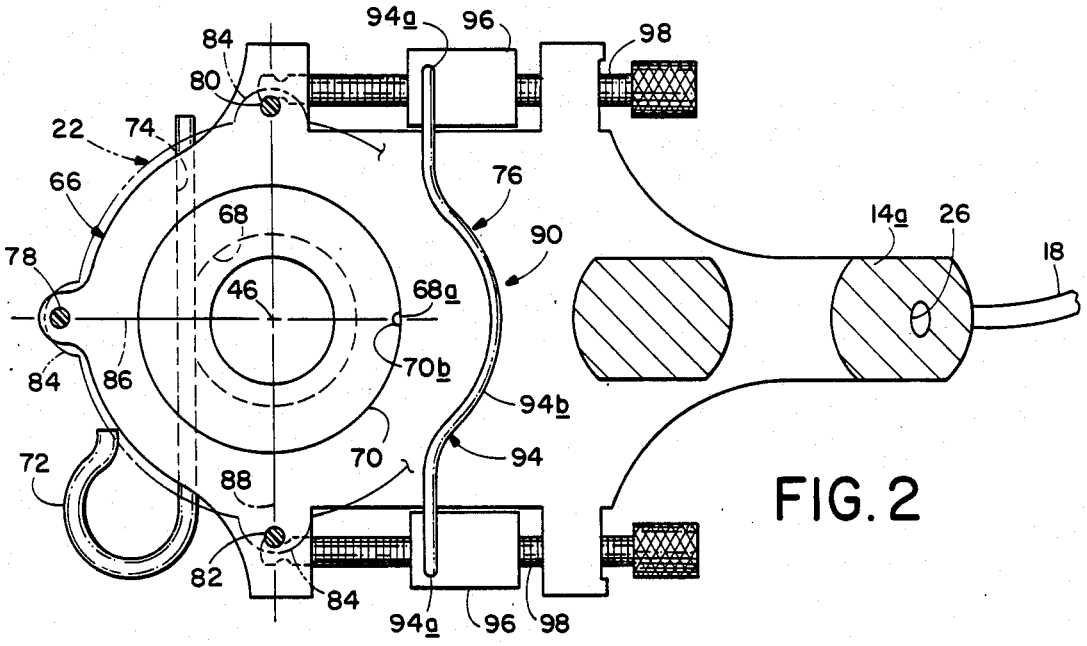
FIG. 2 is a top plan view of a die platform of the instant invention, taken generally along the lines 2—2 in FIG. 1.

Turning now to FIG. 2, a die platform 66 is shown in greater detail. Platform 66 is an extension of frame 12 which projects ahead of grip 14. Platform 66 has a die receiving bore 68 formed therein. Bore 68 receives a die, or die means 70. Die 70 is held in place by a pin 72 which is inserted in a pin keeper 74, formed in platform 66.

The upper portion of bore 68 is enlarged to receive a flange 70*a* of die 70. Die 70 further has an indent 70*b* formed in the outer periphery thereof. Indent 70*b* is keyed on a protrusion 68*a*, formed in the side wall of the enlarged portion of bore 68. Although the punch element and die depicted in the preferred embodiment are circular in form, it is possible to punch holes in gasket material with shapes that are non-circular. In order to accomplish non-circular punching, die 70 and punch element 58 must be properly aligned. The provision of second indent 60 and protrusion 68*a*, and the conformal structures on punch element 58 and die 70 provide that the punch element and die will be properly aligned for non-circular punching.

Referring now to FIGS. 1 and 2, punch positioning means are shown generally at 76. In the preferred embodiment, punch positioning means includes guide elements, such as those shown at 78, 80 and 82. The guide elements are mounted on punch positioning flanges, such as flange 84 which protrude about the periphery of base 36 of cylinder 20. Flanges 84 are arranged to position the guide elements so as to provide an indicator to the punch user showing where the center of the punch is in relation to the gasket material. Element 78 is aligned with a center line axis 86 which extends along the center line of punch 10. Another axis 88 extends normal to axis 86 and locates the rearward center of element 58 relative to the leading edge of the punch. The point of intersection of axis 86 and axis 88 is coincident with an extension of shaft axis 46. Thus an operator looking down on the punch from above will be able to align the center of the punch element and die visually by reference to the guide elements.

Positioning means 76 further includes an adjustable bail, shown generally at 90 which is provided to limit the incursion of gasket material into what is referred to as the punching region, shown generally at 92 in FIG. 1. Bail 90 includes a bail wire 94 which extends across die platform 66. Each end of wire 94 is fixed in a moveable block 96 for movement towards and away from punching axis 46. Blocks 96 may be adjusted by means of threaded shafts 98, which are rotatably fixed in die platform 66.

The rearward limit of gasket material into punching region 92 is determined by the location of upright portions 94*a* of bail wire 94. The transverse portion 94*b* of bail wire 94 has a curve segment in the region of center line axis 86 to prevent contact between wire 94 and collar 62 as punch element 58 is lowered into die 70.

In addition to aiding the user to position punch 10, punch positioning means also helps to prevent the introduction of non-gasket material into punching region 92. The guide elements extend downward from the base of cylinder 20 and are of a length and are positioned such that they substantially enclose punching region 92 except for an area immediately above die platform 66. This arrangement is believed to be relatively effective as a means for keeping the operator's fingers out of the punching region.

In operation, punch 10 is connected to an air line, such as hose 18. Line 18 may be pressurized internally to a pressure of between 65 and 175 lbs. The operator grasps the punch and positions it on gasket material 100 to be punched. Bail 90 will have been adjusted ahead of time to allow proper separation between the edge of the gasket material to be punched and the location of the punch in the material. When the punch is properly aligned, through the use of bail 90 and the guide elements, the operator depresses valve 24 allowing air, in the form of a fluid pulse, to enter the top of piston chamber 30 through a fluid entry/exit port 102. Entry of air into the top of chamber 30 forces piston 48 and piston shaft 44 downward along axis 46 to their punch position thereby causing punch element 58 to encounter gasket material 100, which is perforated by element 58, as backed up by die 70. As element 58 punches material 100, stripper 64 flexes, assuming the shape shown in dashed lines in FIG. 1. An ambient air port 104 allows air which is in chamber 30 below the level of piston 48 to exit the chamber as piston 48 is forced down.

Release of valve 24 allows air in the upper portion of chamber 30 to flow out of the chamber through entry/exit port 102. Valve 24 is configured so that the air escaping the top of chamber 30 may flow past the valve and escape into the ambient atmosphere around valve 24. As valve 24 is released, spring 54 forces piston 48 upwards in the chamber to its rest position and air is drawn in through port 104 to fill the bottom of the chamber.

Punch element 58 and die 70 may be made interchangeable and may be constructed to punch holes from $\frac{1}{8}$th inch diameter through $1\frac{1}{4}$ inch diameter, generally in $\frac{1}{8}$th inch increments. Although the punch and die have been shown as circular structures, other shapes of punches and dies may be provided as are required for the individual tasks to be performed by the punch. Non-circular forms would require that the punch and die elements be aligned with each other to insure conformity at any given point between the punch and die. Proper alignment is provided by the second indent 60 on piston shaft 44 and by protrusion 68*a* in die receiving bore 68.

As valve 24 is released, and the piston and shaft return upward, stripper 64 returns to its undeformed condition, thereby forcing material 100 off of punch element 58.

Although a preferred embodiment of the invention has been illustrated, it should be appreciated that variations and modifications may be made thereto without departing from the spirit of the invention.

It is claimed and desired to secure by Letters Patent:

1. In combination with a pressurized fluid supply, a hand-held powered gasket punch comprising:

a frame having a fluid conduit therein, a grip, a piston chamber, and a die platform spaced beneath said piston chamber, wherein a punching region is defined between said piston chamber and said die platform; wherein said piston chamber includes a fluid entry/exit port in the upper portion thereof, an ambient air port in the lower portion thereof, and a base, said base having a piston-shaft guide-bore centered therein;

a fluid connector for connecting said fluid conduit to the fluid supply;

a piston-shaft mounted for reciprocating movement between a rest position and a punch position in said guide bore; said shaft having punch receiving means on one end thereof;

a piston fixed adjacent the other end of said shaft operable, with a fluid pulse from said fluid supply, to shift said shaft from said rest position to said punch position;

piston-shaft return means operable to return said shaft to said rest position upon cessation of said fluid pulse;

valve means operable with the fluid supply to selectively generate and release said fluid pulse;

punch means removably affixed to said punch receiving means;

resilient stripping means carried on said punch means for stripping gasket material from said punch means;

die means removably affixed on said die platform; and punch positioning means for positioning the punch relative to the gasket material, said positioning means including an adjustable bail for limiting the incursion of gasket material into the punching region, wherein said bail is mounted on movable blocks arranged on opposite sides of said die platform.

2. The punch of claim 1 wherein said shaft has an axis extending the length thereof and said punch means is mounted on said shaft with the center of said punch means coincident with said axis, said punch means and said die means include interchangeable punch and die elements, respectively, for forming a wasted area in gasket material of plural selected sizes, said punch elements having a punch surface thereon.

3. The punch of claim 2 wherein said punch surface is substantially planar and intersects an extension of said axis at a non-normal angle.

4. The punch of claim 2 wherein each punch element includes key means for positioning said element in a predetermined position relative said punch receiving means and wherein said each die element also includes key means for positioning each element in a predetermined position relative said die platform, thereby to consistently orient the punch elements relative the die elements.

5. The punch of claim 2 wherein said resilient stripping means includes a sleeve conformal with the side walls of said punch element and which extends past the punch surface of said element.

6. The punch of claim 1 wherein said positioning means further includes plural guide elements for accurately positioning gasket material relative the punch.

7. The punch of claim 6 wherein said guide elements are distributed relative said piston chamber to provide an indication of the center point said punch element.

8. A hand-held pneumatically powered gasket punch for use with a pressurized air supply, for punching holes in gasket material comprising:

a frame having a hand grip integrally formed therein, a die platform extending forward of said grip at the base of the frame, and cylinder extending forward of said grip above, and spaced apart from, said die platform, said cylinder having punch positioning flanges carried about its base, one of which, with said grip, determines a punch center line, another pair of flanges being positioned at points, respectively, 90° apart from said first mentioned flange about the periphery of said base in a line extending normal to said center line, the inner section of said center line and said line extending normal thereto comprising a punch center point, said cylinder having a closed top and a base with a central bore having a shaft guide extending into said cylinder;

a connector located at the base of said frame adjacent said grip for connecting the punch to the air supply;

a fluid conduit extending through said grip between said connector and said cylinder;

punch driving means located in said cylinder, said driving means including a piston conformal with the interior of said cylinder, an elongate shaft mounted for reciprocating movement along a shaft axis in said shaft guide, one end of said shaft being operably attached to said piston, the other end of said shaft having punch centering indent therein, and piston biasing means operable to hold said piston adjacent the top of said cylinder, said biasing means extending between the base of said cylinder and the bottom surface of said piston;

punch control means including a manually operated valve located adjacent top of said grip, interposed in said conduit between said connector and said cylinder and operable alternately to interrupt and allow the flow of air to said cylinder; and punch positioning means including plural guide elements for accurately positioning gasket material relative of the punch and an adjustable bail for limiting the incursion of gasket material into the punch.

9. The punch of claim 8 which includes a punch element fixed to the other end of said shaft and a die element received in said die platform, said punch element and said die elements having means to prevent rotation about said shaft axis relative one another.

10. The punch of claim 9 wherein said punch element has a lower surface which is beveled relative to said shaft axis.

11. The punch of claim 9 which further includes a resilient stripping sleeve conformal with the side walls of said punch element and which is operable to strip gasket material from said punch element once the gasket material has been punched.

* * * * *